US007182173B2

(12) United States Patent
Bailey

(10) Patent No.: US 7,182,173 B2
(45) Date of Patent: Feb. 27, 2007

(54) MATERIAL-HANDLING DEVICE FOR AERIAL WORK PLATFORM

(76) Inventor: Jeffrey H. Bailey, 3215 Heartland La., Racine, WI (US) 53402

( * ) Notice: Subject to any disclaimer, the term of this patent is extended or adjusted under 35 U.S.C. 154(b) by 100 days.

(21) Appl. No.: 10/603,966

(22) Filed: Jun. 25, 2003

(65) Prior Publication Data

US 2004/0262079 A1 Dec. 30, 2004

(51) Int. Cl.
*B66F 11/00* (2006.01)

(52) U.S. Cl. ..... 182/2.1

(58) Field of Classification Search ..... 182/2.1–2.11, 182/63.1, 69.4–69.6
See application file for complete search history.

(56) References Cited

U.S. PATENT DOCUMENTS 3,295,633 A * 1/1967 Milner, Jr. ..... 182/222
4,359,137 A * 11/1982 Merz et al. ..... 182/2.11
4,360,077 A * 11/1982 Abbott ..... 182/2.11
4,518,059 A * 5/1985 Frey-Wigger ..... 182/2.7
4,657,109 A * 4/1987 Sterner ..... 182/2.1
4,744,718 A * 5/1988 Logan et al. ..... 414/724
5,107,954 A 4/1992 Fujimoto
5,116,189 A * 5/1992 Shammout ..... 414/722
5,431,526 A * 7/1995 Peterson et al. ..... 414/543
5,683,063 A 11/1997 Seiders et al.
6,325,749 B1 * 12/2001 Inokuchi et al. ..... 483/13

* cited by examiner

*Primary Examiner*—Alvin Chin-Shue
(74) *Attorney, Agent, or Firm*—Jansson Shupe & Munger Ltd.

(57) ABSTRACT

An improved aerial work apparatus of the type having an aerial work platform attached to the distal end of a boom mounted to a mobile chassis comprising a material-handling device mounted with respect to the platform. Preferably, the material-handling device is either a dual winch device, a fork lift device, or material support feet. An aerial work platform comprising a rail support frame attached to the boom and a work basket is provided wherein the work basket can be interchanged between a basket in front of the boom and a basket positioned alongside the boom.

44 Claims, 6 Drawing Sheets

MATERIAL-HANDLING DEVICE FOR AERIAL WORK PLATFORM

FIELD OF THE INVENTION

This invention is related generally to aerial work apparatus and, more particularly, to aerial work apparatus having material-handling devices mounted to and controlled from a aerial work platform attached to the distal end of a boom on the apparatus.

BACKGROUND OF THE INVENTION

Aerial work apparatus are well known as excellent tools for lifting workers or material to elevated or obstructed locations. Such equipment are provided with an extendible boom which can be rotated on the base to which it is mounted as well as elevated at varying angles to the ground. The boom is typically mounted either to the back of a vehicle or to a self-propelled mobile chassis.

The typical aerial work apparatus will have attached at the outer end of the boom either an aerial platform with which to lift work personnel or a material-handling device such as a winch or forklift with which to lift tools and supplies to and from an elevated work site. Since the choice of device attached to the boom is permanent and not exchangeable, a separate apparatus is therefore needed for each type of lifting operation. In particular, while one aerial lift may be needed to raise material to an elevated work site, a different lift will be required to provide a working platform for those individuals needed to complete the job.

Although a certain amount of material can be carried with the workers in their aerial platform, space and safety considerations limit in most instances the number and size of such items. Moreover, there has been an understandable tendency to avoid placing personnel in the air with a heavy load. This is unfortunate given the fact that the work platform is provided with a control module that allows personnel on the platform to not only control boom angle, boom extension, and boom rotation, but where the boom is mounted on a self-propelled mobile chassis, to also control movement on the ground of the entire apparatus as well. Such control enables the operator on the aerial work platform to achieve close proximity to the work site.

Any aerial work apparatus used for typical material handling operations, on the other hand, can only be controlled by an individual on the ground. The operator often has difficulty maintaining visual contact with the load being lifted or with the drop point for that load because of his distance from the load and/or intervening obstructions. As a result, accurate placement of the material at the desired location will often be subject to guesswork unless the operator is assisted by one or more co-workers spotting for him. Even with spotters, however, control over a load can be a problem when it is being lifted by a winch. Given the tendency of the load to rotate when supported by a single line, there is little an operator can do under those circumstances to keep the load in a desired orientation.

There is a significant need, therefore, for an improved aerial work apparatus that would allow for more accurate lifting and placement of material at work sites. An aerial lift that accomplishes this as well as gives control in the choice of material handling devices to an operator working from an aerial work platform would be even more highly desirable. This invention meets these needs and overcomes other problems and shortcomings in the prior art.

OBJECTS OF THE INVENTION

It is a primary object of this invention to provide an improved aerial work apparatus that overcomes some of the problems and shortcomings of the prior art.

Another object of this invention is to provide an improved aerial work apparatus that offers the operator a choice in the material handling device by which a load can be lifted.

Another object of this invention is to provide a novel aerial work apparatus where the material handling device can be controlled by an operator both above the ground in an aerial work platform and on the ground.

Another object of this invention is to provide an exceptional aerial work apparatus having a dual winch device that allows for highly reliable and accurate placement of a load.

Another object of the invention is to provide an excellent aerial work apparatus where the work platform is interchangeable between a back basket and a front basket.

Another object of the invention is to provide an improved aerial work apparatus having a dual winch device attached to an aerial work platform where the operational height and reach of the winch assemblies can be increased or reduced.

Another object of the invention is to provide a novel aerial work apparatus where a fork lift device is attached to an aerial work platform to allow a fork lift device to be controlled by an operator above the ground for highly reliable and accurate placement of a load.

Another object of the invention is to provide an exceptional aerial work apparatus that combines a work platform with a varied material handling capability and yet is simple to construct, easy to maintain, as well as highly reliable to operate.

SUMMARY OF THE INVENTION

This invention is for an improvement to an aerial work apparatus of the type having a boom mounted with respect to a mobile chassis, an aerial work platform attached with respect to the distal end of the boom, and a platform control module mounted with respect to the platform for controlling the position of the platform and movement of the self-propelled mobile chassis. The improvement comprises a material-handling device mounted with respect to the platform. The ability to provide a highly stable material-handling device that can be permanently or temporarily attached to an aerial work platform represents a clearly advantageous and novel advance to the art.

In one preferred embodiment of this invention, the material-handling device is a dual winch device comprising two winch assemblies and a winch control module to control either or both assemblies. In another highly preferred embodiment, the material-handling device is a fork lift device. It is most preferred that the material-handling device include both the dual winch device and the fork lift device whereby material-handling is interchangeable between the two devices. In any of these configurations, a worker on an aerial platform now has the ability to operate a material-handling device from that platform as well. This means one person is capable of accomplishing more work and performing that work more efficiently and effectively.

A certain desired embodiment finds the platform comprised of a rail support frame attached with respect to the boom, where the rail support frame has a boom side and an outer side, and a work basket that is removably mounted to the rail support frame. In one preferred form of this embodiment, the work basket is a front basket mounted on the outer side of the rail support frame. The front basket has a length that permits it to comfortably hold more than one person. It is highly preferred in this form of the invention that the material-handling device be a dual winch device having first and second winch assemblies and a winch control module. The availability of two winches facilitates the leveling of loads that are wide and extend substantially beyond either or both sides of the platform.

Where the material-handling device is a dual winch device, it is most preferred that each winch assembly have a winch-support comprised of at least an upper winch-support member that is slidably disposed to a lower winch-support member. This form of the embodiment allows the operational height of each winch assembly to be raised or lowered. Another highly preferred form of this embodiment finds each winch assembly with a winch-jib comprised of at least an outer winch-jib member slidably disposed to an inner winch-jib member. In this form, the operational extension of each winch assembly can be extended and retracted.

In certain preferred embodiments, the first and second winch assemblies of the dual winch device are mounted at opposite ends of the rail support frame. A most desired form of this embodiment has the dual winch device permanently attached to the rail support frame.

One preferred embodiment is where the material-handling device comprises at least two material support feet. This device is nested under the front basket from where it can be slid out for use. When extended, the material support feet are positioned, along with the platform, by means of the platform control module. Where the work basket is a front basket, it is highly preferred to combine use of material support feet with a dual winch device.

Another most preferred embodiment of this invention is where the work basket is a back basket mounted on the boom side of the rail support frame. The back basket is limited in size by the presence of the boom. As a result, the back basket is best suited for holding no more than a single individual.

In a highly preferred form of this embodiment, the material-handling device is a fork lift device that includes tines projecting from the outer side of the rail support frame. It is most desired that the fork lift device is capable of being temporarily mounted to the rail support frame where it can be easily removed. One preferred embodiment combines the back basket with not only the fork lift device but also a dual winch device.

In another aspect of this invention, it is an improvement to an aerial work apparatus of the type having a boom mounted with respect to a boom base and an aerial work platform attached with respect to the distal end of the boom. The term "boom base" refers to both a self-propelled mobile chassis as well as a vehicle-mounted base, such as on the bed of a trailer pulled by a truck. The vehicle-mounted base remains stationary when the boom is in use. The improvement is comprised of at least two material-handling devices being mounted with respect to the platform.

One most preferred embodiment finds one of the material-handling devices to be a fork lift device. Another desired form has at least two material support feet serving as one of the material-handling devices.

A highly preferred embodiment of this aspect of the invention is where one of the material-handling devices is a dual winch device.. One of the material-handling devices could also be single winch assembly permanently attached to the platform. In a highly desired embodiment, the dual winch device is also permanently attached to the platform.

In another embodiment of this aspect of the invention, it is preferred that the aerial work platform be comprised of a rail support frame and a work basket removably mounted to the rail support frame. It is most preferred with this embodiment that the work basket be a front basket mounted on the outer side of the rail support frame. In this form, it is highly desired that one of the material-handling devices be a dual winch device. Another preferred aspect of this embodiment finds one material-handling device to be at least two material support feet.

Another highly desired embodiment is where the work basket is a back basket mounted on the boom side of the rail support frame. With this embodiment, it is preferred that one material-handling device be a fork lift device and most preferred that this device be removable. It is also desirable that one of the material-handling devices be a dual winch device.

Another aspect of this invention is directed to an improved aerial work apparatus having an aerial work platform extending from a boom mounted with respect to a boom base where the improvement comprises a dual winch device attached to the platform, the device having first and second winch assemblies and a winch control module to control the assemblies. A preferred embodiment of this invention is where the winch assemblies can be raised or lowered and/or extended outward or retracted inward. It is most preferred that the assemblies are permanently attached to the platform.

In one other aspect of this invention, the improvement is also to an aerial work apparatus having an aerial work platform attached to a boom mounted on a boom base. This improvement has both a fork lift device and a platform control module to control the position of the platform mounted on the platform. A highly desirable embodiment of this aspect is where the device can be repeatedly removed and then later reattached to the platform.

One additional example of this invention constitutes another improvement to an aerial work apparatus of the type having a boom mounted to a boom base and an aerial work platform attached to the distal end of the boom. This improvement is where the platform is comprised of both a rail support frame attached to the boom and a work basket removably mounted to the rail support frame. The work basket is mounted to the rail support frame in a manner where it can be lifted off and then reattached to the rail support frame with minimal effort and without the need for tools.

A preferred embodiment of this invention is where the work basket is a front basket mounted on the outer side of the rail support frame. In this embodiment, it is highly preferred that a dual winch device be mounted to the platform and, in particular, that the two winch assemblies be mounted at opposite ends of the rail support frame. The device includes a winch control module that is mounted to the platform for controlling the dual winches. It is also desirable that the front basket have at least two material support feet slidably engaged to it.

Another most desired embodiment is where the work basket is a back basket mounted on the boom side of the rail support frame. Here it is highly favored that the apparatus further be comprised of a removable fork lift device having tines projecting from the outer side of the rail support frame.

As used herein, the term "material-handling device" refers to any device for engaging, lifting, raising or lowering material. Such material-handling devices include the aforementioned winch devices (both dual and single), a fork lift device and material support feet. The term "aerial work platform" refers to any device, typically a basket, designed to provide a horizontal standing surface with surrounding rails for standing or working by one or more persons.

DETAILED DESCRIPTION OF PREFERRED EMBODIMENTS

Figure 1:
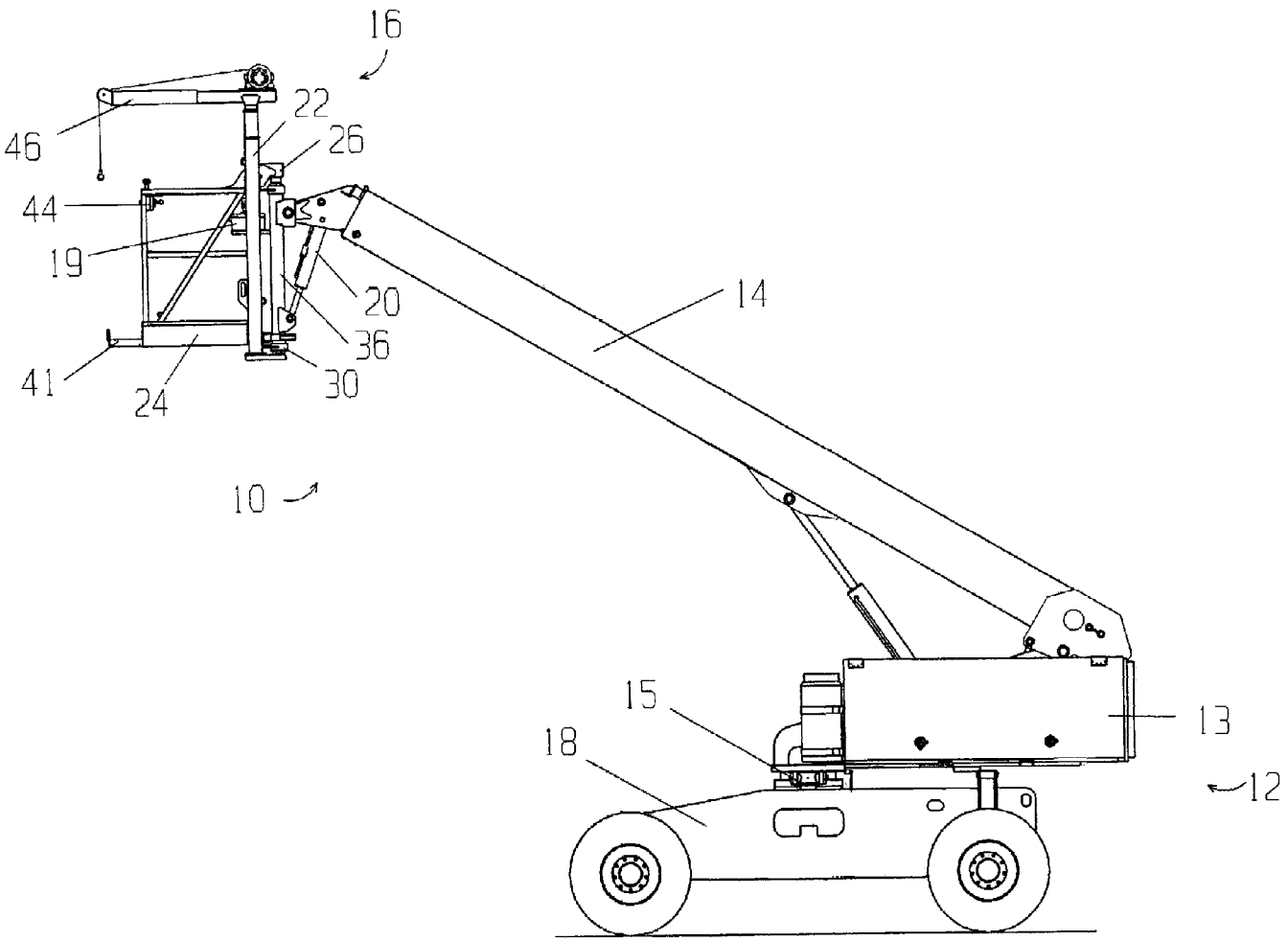
FIG. 1 is a side view of a preferred aerial work apparatus in accordance with this invention.

The drawings illustrate an improved aerial work apparatus 10 in accordance with this invention. As illustrated in FIG. 1, aerial work apparatus 10 is comprised of mobile chassis 12, boom 14 securely mounted to the chassis base 13 of mobile chassis 12, and aerial work platform 16 pivotably attached to the outer or distal end of boom 14. Mobile chassis 12 is of known construction, having a wheel base 18 under power that allows mobile chassis 12 to be driven in a controlled fashion. Controls for driving mobile chassis 12 are located both on chassis base 13 and on platform 16 as a portion of platform control module 19.

Boom 14 is capable of a variety of movements in a fashion known to those skilled in the art. Boom 14 can rotate 360° in either direction in a horizontal plane through the associated rotation of chassis base 13 about its base pivot 15. Boom 14 can also be selectively raised and lowered to a position measured by the angle formed by boom 14 with the ground. Furthermore, boom 14 can be telescopically extended or retracted axially.

Aerial work platform 16 is comprised of a work basket 24 removably attached to a rail support frame 22. Platform support member 26 and upper and lower sleeve bearings 28, 30 are rigidly connected to rail support frame 22 along vertical strut 31 (not seen in FIG. 1 but shown in FIGS. 4 and 6).

Figure 2:
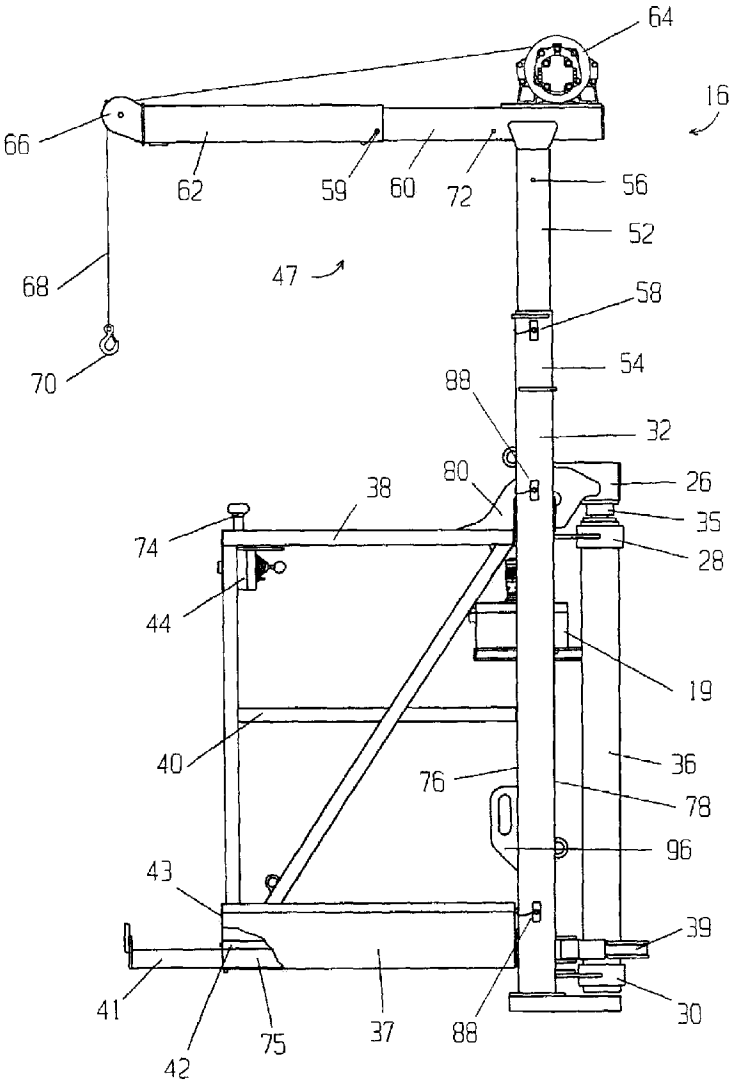
FIG. 2 is a side view of the aerial work platform with front basket of FIG. 1 with partial cut-out of basket floor.

As seen in FIGS. 1 and 2, boom 14 is provided at its distal end with a vertical support column 36. Platform 16 is mounted onto boom 14 by resting platform support member 26 upon bushing 35 at the top of support column 36. Sleeve bearings 28, 30 are spaced beneath platform support member 26 and pivotally engage support column 36 at points that are substantially adjacent to the top and bottom of support column 36.

This manner in which aerial work platform 16 is mounted to boom 14 allows platform 16 and, in particular, work basket 24 to pivot in a substantially horizontal plane about support column 36 by means of hydraulic platform rotational cylinder 39. Support column 36 (and, in turn, rail support frame 22) is maintained substantially vertical by hydraulic slave-leveling cylinder 20 extending from boom 14.

Figure 4:
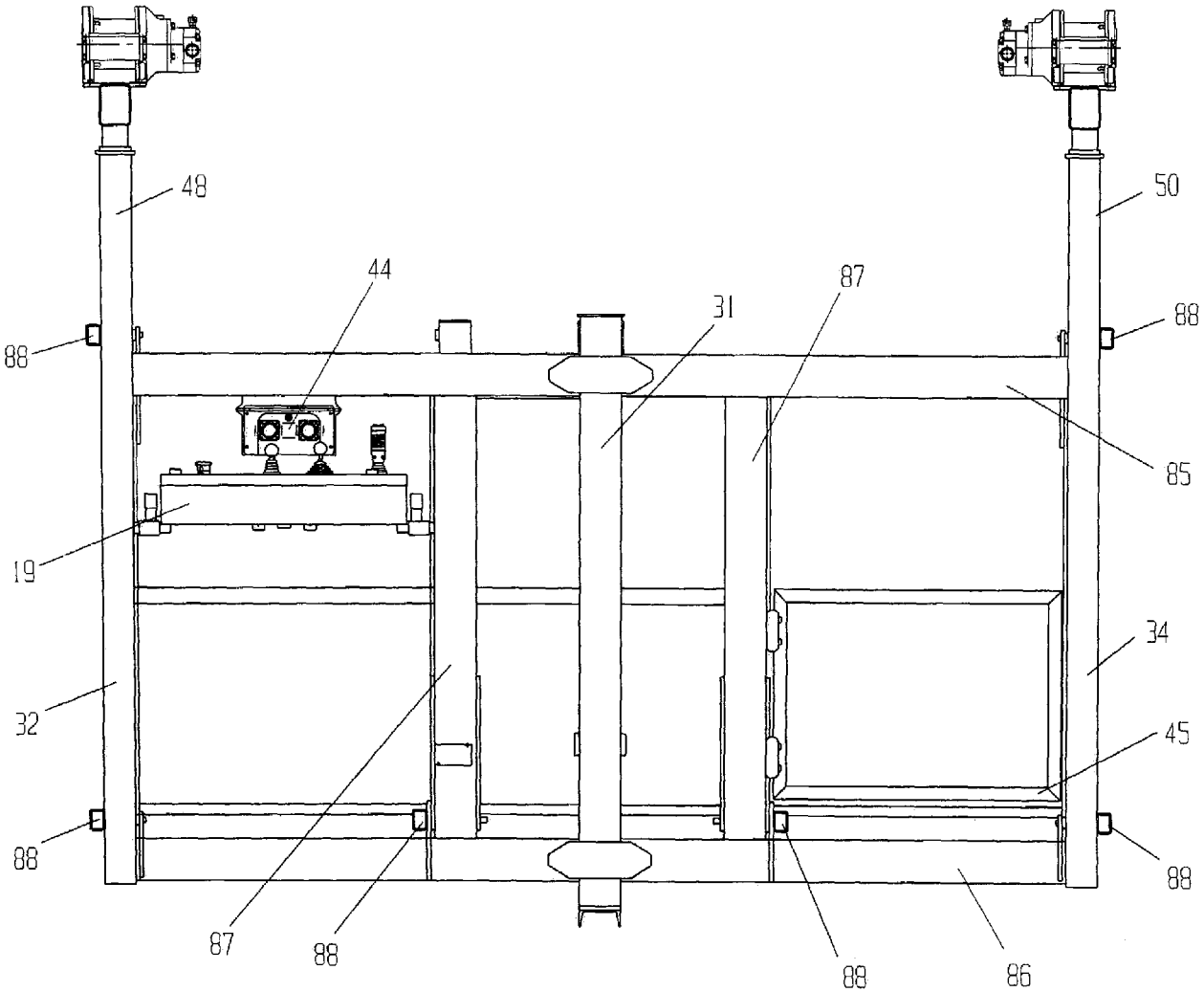
FIG. 4 is a rear view of aerial work platform of FIG. 2.

The work basket 24 illustrated in FIG. 2 is front basket 37. Front basket 37 is a rigid open structure of interconnected tubular steel elements that include top bar 38, middle bar 40, and basket floor 42. Front basket 37 provides a supporting structure in which more than one worker can stand while accomplishing their desired tasks. As shown in FIG. 4, access to front basket 37 is provided by platform door 45 mounted on rail support frame 22. Platform control panel 19 is slideably mounted to rail support frame 22 at a working height. Platform control panel 19 allows workers in front basket 37 to move front basket 37 in a well-known manner through a three-dimensional field independent of personnel on the ground.

Aerial work platform 16 is provided with a material handling device 46 that is shown in FIG. 2 to be a dual winch device 47. FIGS. 2–6 illustrate that dual winch device 47 is comprised of first and second winch assemblies 48, 50 and winch control module 44. Each winch assembly 48, 50 is comprised of a winch-support 49 and a winch-jib 51. Each winch-support 49 has an upper winch-support member 52 and a lower winch-support member 54. Lower winch-support members 54 are tubular steel structures integral with and extending from first end 32 and second end 34 of rail support frame 22. Upper winch-support members 52 are tubular steel elements telescopically received by a corresponding lower winch-support members 54.

Upper winch-support members 52 are each provided with at least two pairs of winch-support apertures 56. Lower winch-support members 54 are each provided with one pair of winch-support apertures 56. Each pair of winch-support apertures 56 has one winch-support aperture in horizontal registry opposite from the other. The pairs of winch-support apertures 56 located on upper winch-support members 52 are spaced in vertical alignment along the length of each upper winch-support member 52.

Each upper winch-support member 52 is secured within the respective lower winch-support member 54 by first positioning upper winch-support member 52 in a manner whereby one pair of support-apertures 56 on upper winch-support member 52 is in registry with the pair of winch-support apertures 56 on lower winch-support member 54. After proper alignment has been accomplished, a support hitch pin 58 is inserted through all four winch-support apertures 56 of the two matching pairs. Support hitch pin 58 is preferably held in place by insertion of a lock pin (not shown) through a hole provided in the distal end of support hitch pin 58. By repeating this process with the applicable combinations of pairs of winch-support apertures 56, upper winch-support member 52 can be raised or lowered to increase or decrease the operative height of first and second winch assemblies 48, 50.

As further illustrated in FIG. 2, each winch-jib 51 has an inner winch-jib member 60 and an outer winch-jib member 62. Each inner winch-jib member 60 is a tubular steel unit rigidly secured, preferably by welding, to the top of a corresponding upper winch-support member 52. A cable winch 64 is firmly mounted on the upper surface of each inner winch-jib member 60. Outer winch-jib members 62 are each tubular steel structures that telescopically receive a corresponding inner winch-jib member 60. A cable sheave 66 is attached to the distal end of each outer winch-jib member 62. Cable sheaves 66 maintain winch cable 68 in a vertical plane for lifting loads attached to the corresponding winch hook 70 extending from the free end of winch cable 68.

Outer winch-jib members 62 are each provided with one pair of jib-apertures 72. Inner winch-jib members 60 are each provided with at least two pairs of jib-apertures 72. Each pair of jib-apertures 72 has one jib-aperture in horizontal registry opposite from the other. The pairs of jib-apertures 72 located on inner winch-jib members 60 are spaced in horizontal alignment along the length of each inner winch-jib member 60.

In a manner similar to that described for winch-supports 49, outer winch-jib members 62 are secured to inner winch-jib members 60 by first positioning each outer winch-jib member 62 so that the pair of jib-apertures 72 is in registry with one of the pairs of jib-apertures 72 on the corresponding inner winch-jib member 60. After proper alignment has been achieved, jib hitch pin 59 is inserted through all four jib-apertures 72 of the two matching pairs. Jib hitch pin 59 is preferably prevented from slipping out of position by inserting a lock pin (not shown) through a hole provided in the distal end of jib hitch pin 59. Repositioning of outer winch-jib members 62 in this fashion permits winch-jibs 51 to be extended or retracted so that the effective reach of first and second winch assemblies 48, 50 can be increased or reduced.

Each adjustment of a winch-support 49 or a winch-jib 51 must be coordinated with an identical adjustment to the other winch-support or winch-jib member. Otherwise, a load lifted by the dual winch assemblies 48, 50 in tandem will fail to have the load supported in the preferred manner, i.e. where hooks 70 are in horizontal alignment and in a plane parallel to the plane of rail support frame 22.

Both winch assemblies 48, 50 are operated from winch control module 44. Winch control module 44 has a housing that includes a spring-loaded release pin 74 whereby winch control module 44 can be removably attached to work basket 24 at multiple locations. In this fashion, winch control module 44 can always be in a location most convenient to the operator for the task being performed.

Figure 5:
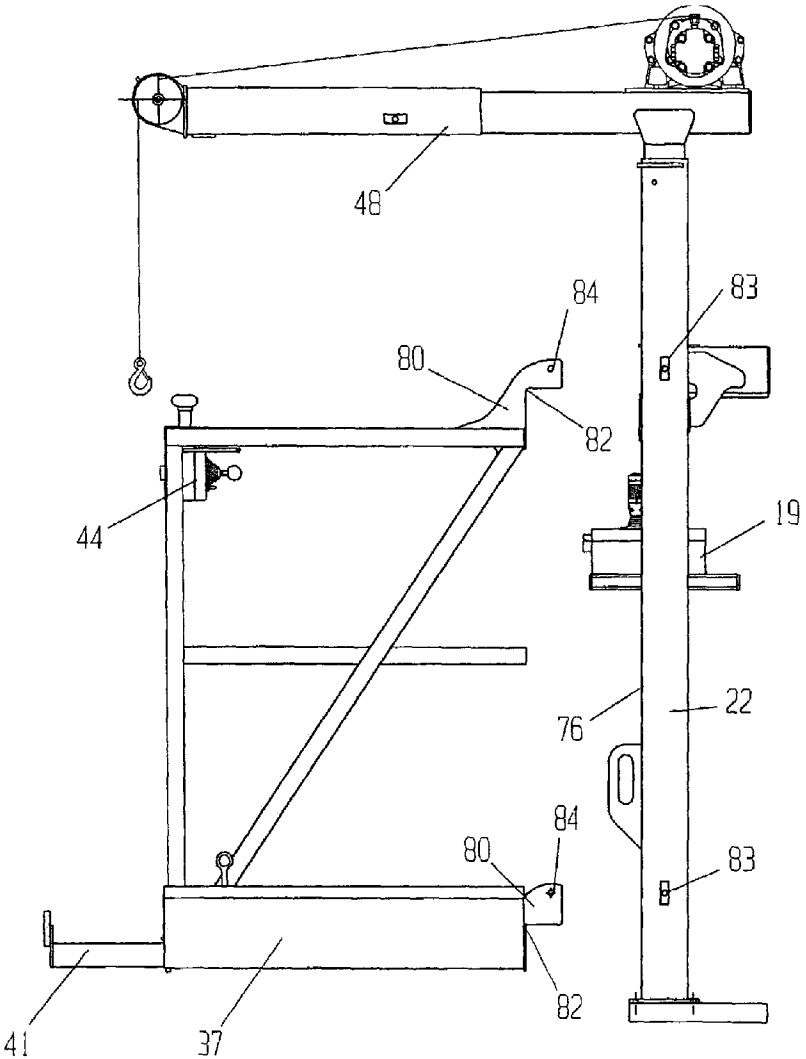
FIG. 5 is a side view of aerial work platform of FIG. 2 with front basket disengaged from rail support frame.

As illustrated in FIGS. 2 and 5, front basket 37 also includes four material support feet 41 (material support foot 41 shown masks other three behind it). Each material support foot 41 is an elongated member formed of tubular steel that is telescopically received by a corresponding tubular foot receiving member 75. Foot receiving members 75 also serve as a portion of the framework for basket floor 42.

Material support feet 41 can be slidably extended outward in a longitudinal direction away from front wall 43 of front basket 37. A stop (not shown) within foot receiving member 75 prevents the corresponding support foot 41 from inadvertently sliding entirely out from foot receiving member 75.

Each foot receiving member 75 is also provided with a pair of apertures (not shown) with each aperture in vertical registry from the other. Each material support foot 41 is provided with two pair of apertures (not shown) spaced in horizontal alignment along the length of support foot 41, each pair having an aperture in vertical registry with another. Upon extension, material support foot 41 is secured in position by aligning apertures on foot receiving member 75 with a corresponding pair on support foot 41 so that a lock pin can be inserted through all four apertures. In a similar manner, each material support foot 41 is secured in its retracted position within the corresponding foot receiving member 75 with a lock pin by aligning the apertures on receiving member 75 with the second pair of apertures on support foot 41.

In an extended configuration, any number of support feet 41 can be used by the operator to rest or support a load so as to enable the load to be elevated along with front basket 34 by boom 14. Where necessary, after the load is in the air, winch assemblies 48, 50 can be activated to lower the load into position.

Rail support frame 22 has outer side 76 and boom side 78. As seen in FIG. 5, front basket 37 is removably mounted to rail support frame 22 on outer side 76. Front basket 37 is provided with six anchor plates 80. Each anchor plate 80 includes notch 82 and plate-aperture 84. Notch 82 substantially forms a 90° angle that allows notch 82 to rest on either top rail 85 or bottom rail 86 of rail support frame 22. In attaching front basket 37 to rail support frame 22, front basket 37 is lifted onto rail support frame 22 whereby two anchor plates 80 are received by top rail 85 while four anchor plates 80 are received by bottom rail 86.

As illustrated in FIG. 4, when front basket 37 is in position upon rail support frame 22, each anchor plate 80 is adjacent to one of four rail-bracket columns 87 which include first end 32 and second end 34. A pair of rail-bracket apertures 83 is provided each rail-bracket column 87 at each location where anchor plate 80 abuts a rail-bracket column 87. Each pair of rail-bracket apertures 83 is in horizontal registry so that a basket-hitch pin 88 can be inserted through each plate-aperture 84 and each pair of corresponding rail-bracket apertures 83. In this manner, front basket 37 is secured to rail support frame 22. Basket-hitch pin 88 is preferably prevented from working loose by insertion of a lock pin (not shown) through a hole provided in the distal end of basket-hitch pin 88. The operation of attaching or removing front basket 37 from rail support frame 22 is performed without tools in a matter of a few minutes.

Figure 3:
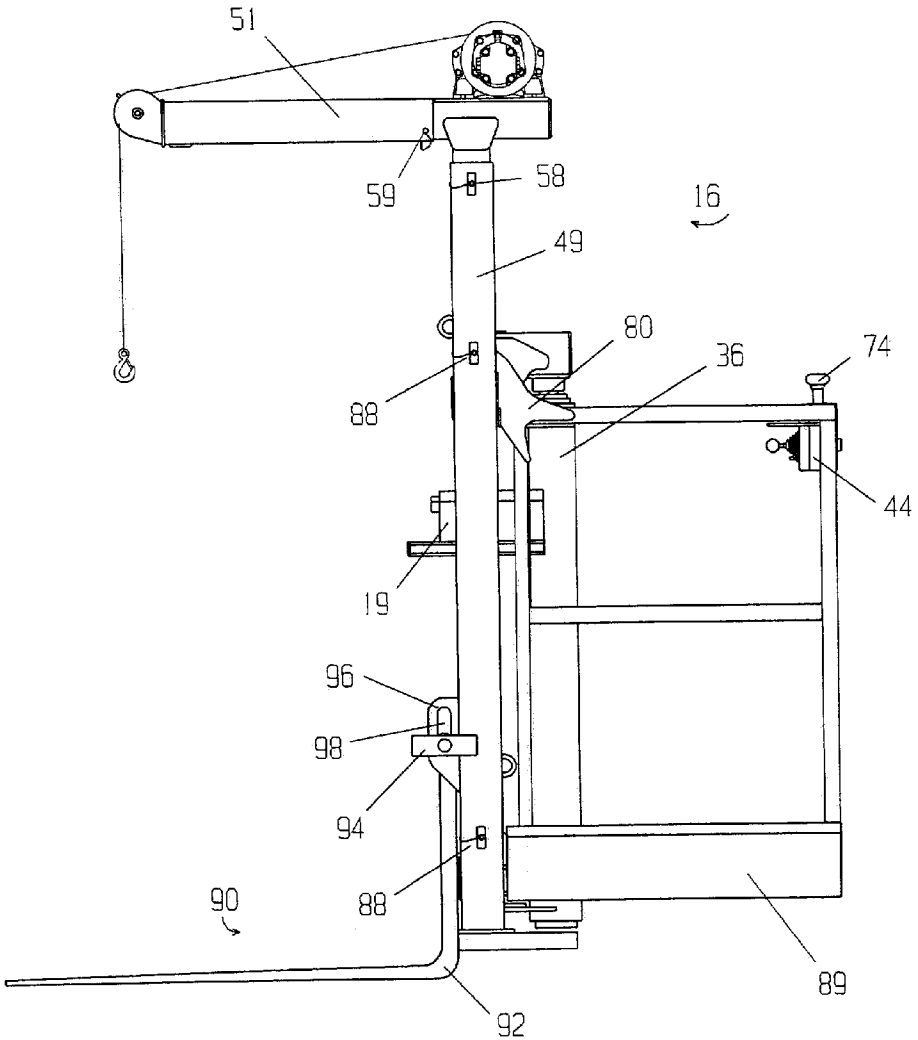
FIG. 3 is a side view of another preferred aerial work platform in accordance with this invention.

FIG. 3 illustrates use of back basket 89 as work basket 24. Back basket 89 is also a rigid open structure of interconnected tubular steel elements. Given the limited space behind rail support frame 22 alongside boom 14, back basket 89 has dimensions that are preferably suited for no more than a single operator.

Figure 6:
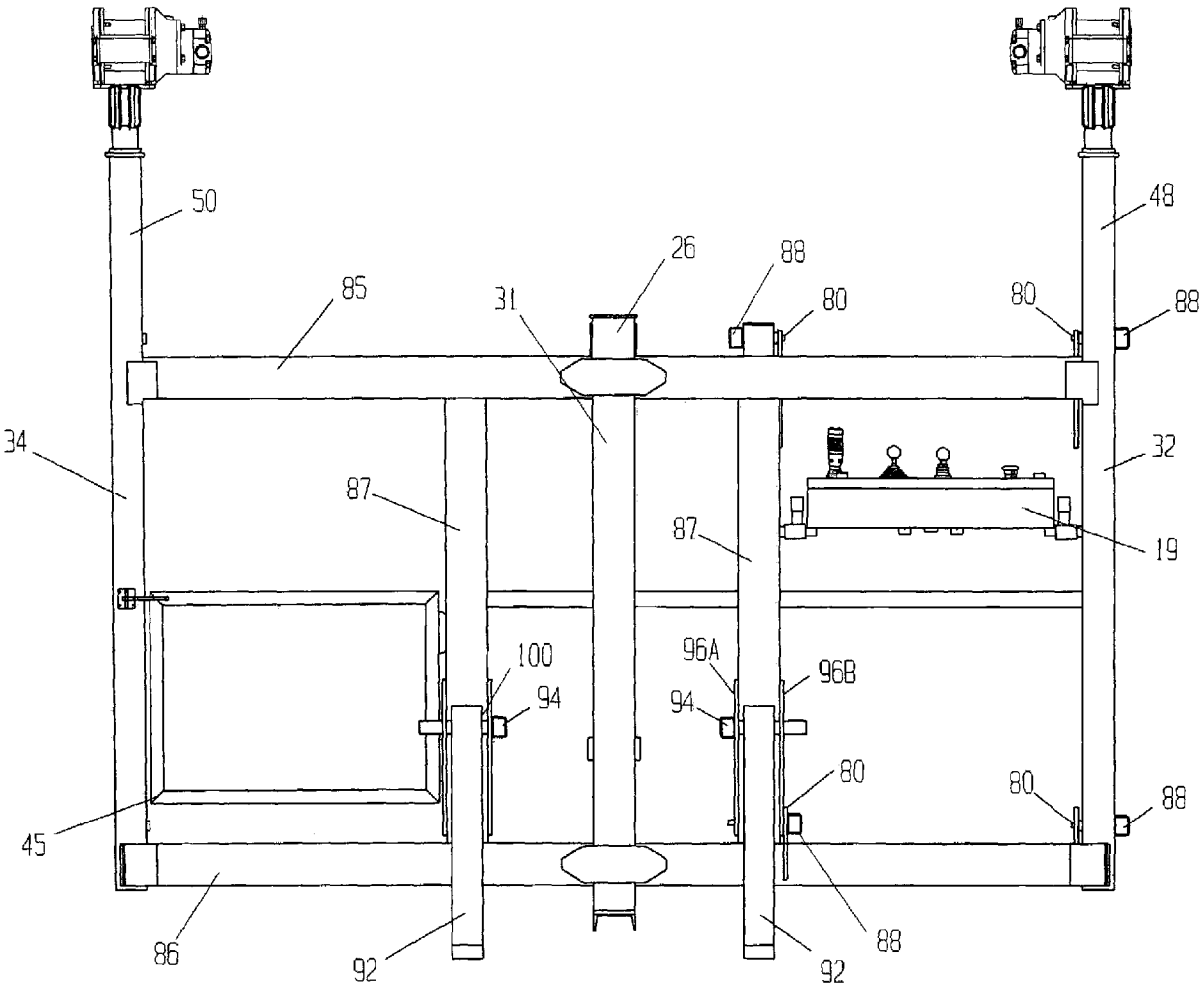
FIG. 6 is a front view of aerial work platform of FIG. 3.

After disengaging front basket 37 from rail support frame 22, back basket 89 can be removably attached to boom side 78 of rail support frame 22. Back basket 89 is provided with four anchor plates 80. FIG. 6 illustrates that back basket 89 is lifted onto rail support frame 22 so that two anchor plates 80 are received by top rail 85 while two anchor plates 80 are received by bottom rail 86. Back basket 89 is preferably attached to rail support frame 22 on the side of vertical strut 31 where platform control module 19 is located. As with front basket 37, after aligning plate-aperture 84 with the corresponding pair of rail-bracket apertures 83, a basket-hitch pin 88 can then be inserted through each anchor plate 80 and adjacent rail-bracket column 87 to firmly secure back basket 89 to rail support frame 22.

Following attachment of back basket 89 to rail support frame 22, platform control module 19 can be easily slid from a position on the outer side 76 of the rail support frame 22 to the boom side 78 to facilitate access by the operator in back basket 89 to the controls on module 19. Likewise, winch control module 44 can be quickly released from its location on front basket 37 via release pin 73 and reattached to a bar on back basket 89. Thus, work basket 24 can be operationally interchanged between a multi-person front basket 37 and a back basket 89.

With the back basket 89 in place, a fork lift device 90 can be mounted to rail support frame 22 for material-handling by aerial work apparatus 10. Fork lift device 90 is comprised of two tines 92 that can be removably engaged to fork-brackets 96 on outer side 76. As shown in FIG. 6, each tine 92 is secured to a pair of fork-brackets 96A, 96B by threading a fork-pin 94 through fork-bracket aperture 98 on fork-bracket 96A, tine-aperture 100, and fork-bracket aperture 98 on fork-bracket 96B.

Use of back basket 89 allows the operator the option of using either fork lift device 90 or dual winch device 47. The availability of both material-handling devices is especially advantageous when the operator is working within a confined area. The absence of front basket 37 in front of rail support frame 22 facilitates closer access to the work site under such conditions.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. In an aerial work apparatus having a boom mounted with respect to a mobile chassis, a aerial work platform attached with respect to the distal end of the boom, and a platform control module mounted with respect to the platform for controlling the position of the platform and movement of the chassis, the improvement comprising at least one material-handling device mounted with respect to the platform and the platform comprising a rail support frame attached with respect to the boom, the rail support frame defining a boom side and an outer side and having at least one substantially horizontal rail extending from a first end to a second end of the frame, and a work basket removably mounted to the rail support frame and supported upon the rail, the rail support frame being adapted to receive the work basket on either the boom side or outer side.

2. The aerial work apparatus of claim 1 wherein the material-handling device is a dual winch device having first and second winch assemblies and a winch control module.

3. The aerial work apparatus of claim 1 wherein the material-handling device is a fork lift device.

4. The aerial work apparatus of claim 1 wherein two material-handling devices are mounted with respect to the platform.

5. The aerial work apparatus of claim 4 wherein the first material-handling device is a dual winch device and the second material-handling device is a fork lift device.

6. The aerial work apparatus of claim 1 wherein the platform control module is slidably mounted to the rail support frame such that the platform control module is free to move from the outer side to the boom side.

7. The aerial work apparatus of claim 1, wherein the work basket is a front basket mounted on the outer side of the rail support frame.

8. The aerial work apparatus of claim 7 wherein the material-handling device is at least two material support feet slidably attached to the front basket such that the feet are free to extend outward in front of the basket.

9. The aerial work apparatus of claim 7 wherein the material-handling device is a dual winch device having first and second winch assemblies and a winch control module, thereby facilitating leveling of substantially horizontally disposed loads.

10. The aerial work apparatus of claim 9 wherein each winch assembly has a winch-support, the winch-support having at least an upper winch-support member slidably disposed with respect to a lower winch-support member, whereby the operational height of the winch assembly can be raised and lowered.

11. The aerial work apparatus of claim 9 wherein each winch assembly has a winch-jib, the winch-jib having at least an outer winch-jib member slidably disposed with respect to an inner winch-jib member, whereby the operational extension of the winch assembly can be extended and retracted.

12. The aerial work apparatus of claim 9 wherein the first and second winch assemblies are mounted at opposite ends of the rail support frame.

13. The aerial work apparatus of claim 12 wherein the dual winch device is permanently attached to the rail support frame.

14. The aerial work apparatus of claim 9 further comprising at least two material support feet, the support feet being slidably attached to the front basket such that the feet are free to extend outward in front of the basket.

15. The aerial work apparatus of claim 1 wherein the work basket is a back basket mounted on the boom side of the rail support frame.

16. The aerial work apparatus of claim 15 wherein the material-handling device is a fork lift device having tines projecting from the outer side of the rail support frame.

17. The aerial work apparatus of claim 16 wherein the fork lift device is removably mounted to the outer side of the rail support frame.

18. The aerial work apparatus of claim 15 wherein the material-handling device is a dual winch device having first and second winch assemblies and a winch control module, thereby facilitating leveling of substantially horizontally disposed loads.

19. The aerial work apparatus of claim 17 further comprising a dual winch device.

20. In an aerial work apparatus having a boom mounted with respect to a boom base and a aerial work platform attached with respect to the distal end of the boom, the improvement comprising at least two material-handling devices, a platform control module mounted with respect to the platform, the platform control module being adapted to control the position of the platform, and the platform comprising a rail support frame attached with respect to the boom, the rail support frame defining a boom side and an outer side and having at least one substantially horizontal rail extending from a first end to a second end of the frame, and a work basket removably mounted to the rail support frame and supported upon the rail, the rail support frame being adapted to receive the work basket on either the boom side or outer side.

21. The aerial work apparatus of claim 20 wherein one material-handling device is a dual winch device having first and second winch assemblies and a winch control module, thereby facilitating leveling of substantially horizontally disposed loads.

22. The aerial work apparatus of claim 21 wherein each winch assembly comprises:

a winch-support, the winch-support having at least an upper winch-support member slidably disposed with respect to a lower winch-support member, whereby the operational height of the winch assembly can be raised and lowered; and a winch-jib, the winch-jib having at least an outer winch-jib member slidably disposed with respect to an inner winch-jib member, whereby the operational extension of the winch assembly can be extended and retracted.

23. The aerial work apparatus of claim 21 wherein the dual winch device is permanently attached to the platform.

24. The aerial work apparatus of claim 20 wherein one material-handling device is a fork lift device having tines projecting from the outer side of the platform.

25. The aerial work apparatus of claim 24 wherein the fork lift device is removably mounted to the platform.

26. The aerial work apparatus of claim 20 wherein one material-handling device is at least two material support feet slidably attached to the platform such that the feet are free to extend outward in front of the platform.

27. The aerial work apparatus of claim 20 wherein the work basket is a front basket mounted on the outer side of the rail support frame.

28. The aerial work apparatus of claim 27 wherein one material-handling device is a dual winch device having first and second winch assemblies and a winch control module, thereby facilitating leveling of substantially horizontally disposed loads.

29. The aerial work apparatus of claim 28 wherein the first and second winch assemblies are mounted at opposite ends of the rail support frame.

30. The aerial work apparatus of claim 27 wherein one material-handling device is at least two material support feet slidably attached to the front basket such that the feet are free to extend outward in front of the basket.

31. The aerial work apparatus of claim 20 wherein the work basket is a back basket mounted on the boom side of the rail support frame.

32. The aerial work apparatus of claim 31 wherein one material-handling device is a fork lift device having tines projecting from the outer side of the rail support frame.

33. The aerial work apparatus of claim 32 wherein the fork lift device is removably mounted to the outer side of the rail support frame.

34. The aerial work apparatus of claim 31 wherein one material-handling device is a dual winch device having first and second winch assemblies and a winch control module, thereby facilitating leveling of substantially horizontally disposed loads.

35. In an aerial work apparatus having a boom mounted with respect to a boom base and a aerial work platform attached with respect to the distal end of the boom, the improvement wherein the platform comprises:

a rail support frame attached with respect to the boom, the rail support frame having a boom side, an outer side, and at least one substantially horizontal rail extending from a first end to a second end of the frame; and a work basket removably mounted to the rail support frame and supported upon the rail, the rail support frame being adapted to receive the work basket on either the boom side or outer side.

36. The aerial work apparatus of claim 35 wherein the work basket is a front basket mounted on the outer side of the rail support frame.

37. The aerial work apparatus of claim 36 further comprising at least two material support feet slidably attached with respect to the front basket such that the feet are free to extend outward in front of the basket.

38. The aerial work apparatus of claim 36 further comprising a dual winch device mounted with respect to the platform, the device having first and second winch assemblies mounted at opposite ends of the rail support frame and a material control module.

39. The aerial work apparatus of claim 35 wherein the work basket is a back basket mounted on the boom side of the rail support frame.

40. The aerial work apparatus of claim 39 further comprising a fork lift device having tines projecting from the outer side of the rail support frame.

41. The aerial work apparatus of claim 40 wherein the fork lift device is removably mounted to the outer side of the rail support frame.

42. An aerial work apparatus of the type having a boom mounted with respect to a mobile chassis and a aerial work platform attached with respect to the distal end of the boom, the aerial work apparatus comprising:

a platform control module mounted with respect to the platform for controlling the position of the platform and movement of the chassis; and at least one material-handling device mounted with respect to the platform, the platform comprises a rail support frame attached with respect to the boom, the rail support frame defining a boom side and an outer side and having a least one substantially horizontal rail extending from a first end to a second end of the frame, and a work basket removably mounted to the rail support frame and supported upon the rail, the rail support frame being adapted to receive the work basket on either the boom side or outer side.

43. The aerial work apparatus of claim 42 wherein the material-handling device is a dual winch device having first and second winch assemblies and a winch control module, the first and second winch assemblies being mounted at opposite ends of the rail support frame.

44. The aerial work apparatus of claim 42 wherein the material-handling device is at least two material support feet slidably attached to the work basket and wherein the work basket is a front basket mounted on the outer side of the rail support frame such that the feet are free to extend outward in front of the basket.

* * * * *